US007766571B2

(12) United States Patent
McLaughlin et al.

(10) Patent No.: US 7,766,571 B2
(45) Date of Patent: Aug. 3, 2010

(54) ACCESSORY FOR A WRITING IMPLEMENT OR THE LIKE

(76) Inventors: Timothy Francis McLaughlin, Unit 84, 2 Goodwin Street, Kangaroo Point, QLD (AU) 4169; Francis Patrick McLaughlin, Unit 84, 2 Goodwin Street, Kangaroo Point, QLD (AU) 4169

( * ) Notice: Subject to any disclaimer, the term of this patent is extended or adjusted under 35 U.S.C. 154(b) by 0 days.

(21) Appl. No.: 11/348,162

(22) Filed: Feb. 6, 2006

(65) Prior Publication Data

US 2006/0193675 A1 Aug. 31, 2006

Related U.S. Application Data

(63) Continuation-in-part of application No. 10/482,533, filed as application No. PCT/AU02/00807 on Jun. 20, 2002.

(30) Foreign Application Priority Data

Jun. 21, 2001 (AU) ..... PR5865

(51) Int. Cl.
*A46B 11/00* (2006.01)
*A46B 17/02* (2006.01)

(52) U.S. Cl. ..... 401/48; 401/88

(58) Field of Classification Search ..... 401/6, 401/48, 88, 92, 93, 95, 98, 131
See application file for complete search history.

(56) References Cited

U.S. PATENT DOCUMENTS

| | | | | |
|---|---|---|---|---|
| 1,704,772 A | | 3/1929 | Spikins | |
| 1,815,451 A | * | 7/1931 | Schneider | 401/79 |
| 1,936,213 A | * | 11/1933 | Snedden | 401/93 |
| 2,968,849 A | | 1/1961 | Cain | |
| 4,522,522 A | * | 6/1985 | Zeitelhack | 401/88 |
| 5,292,202 A | | 3/1994 | Lee | |
| 5,868,509 A | | 2/1999 | Crutcher | |
| 6,095,706 A | | 8/2000 | Hashimoto et al. | |
| 6,149,332 A | | 11/2000 | Huang | |
| 6,276,854 B1 | | 8/2001 | Mullins | |
| 6,322,267 B1 | | 11/2001 | Schaffer-Buck | |

FOREIGN PATENT DOCUMENTS

| | | | |
|---|---|---|---|
| GB | 2200597 A | | 8/1988 |
| JP | 30-17006 A | * | 11/1955 |

OTHER PUBLICATIONS

Derwent Abstract Accession No. 91-206564/28, SU 1588565 A, Aug. 30, 1990.
Derwent Abstract Accession No. E5931 D/20, SU 761302 A, Sep. 30, 1980.

* cited by examiner

*Primary Examiner*—Tuan N Nguyen

(57) ABSTRACT

There is provided an accessory for a writing implement including a body assembly comprising a barrel and a split plug and defining a passage therethrough adapted to receive a pencil. The barrel is provided with an internally threaded end adapted to be engaged by an outer threaded portion of the split plug which is provided with a pair of opposed slots. The respective threaded portions are relatively tapered whereby threaded engagement of the split plug with the barrel causes the slots to close up such that the pencil is retained thereby. The barrel is provided with a pocket clip.

5 Claims, 11 Drawing Sheets

ACCESSORY FOR A WRITING IMPLEMENT OR THE LIKE

CROSS RELATED APPLICATIONS

This application is a Continuation-In-Part Application of U.S. Ser. No. 10/482,533 filed 22 Dec. 2003, which is a U.S. National Phase Application of PCT International Application No. PCT AU02/00807 filed 20 Jun. 2002, which claims priority from Australian Provisional Patent Application No. PR 5865 filed 21 Jun. 2001.

FIELD OF THE INVENTION

The present invention relates to an accessory for a writing implement. This invention has particular but not exclusive use to a holder accessory for a pencil, and for illustrative purposes reference will be made to such a use. However, it is understood that this invention could be used for other applications such as ball-point pens and other pens, hand held scribing and cutting implements and the like.

BACKGROUND OF THE INVENTION

Mass produced wooden pencils are cheap and may be readily sharpened by simple pencil sharpeners. Such pencils are generally round or hexagonal in shape and for the most part are manufactured to a standard size for whichever of these shapes.

When a pencil is sharpened, the length is shortened, and continuing sharpening may result in the pencil becoming too short to conformably use. Some people are unable to use a pencil so compromised, and others will avoid their use, or discard them before their time.

Accessories for lengthening the effective length of wooden pencils have been proposed. Accessories of this type typically have a tubular body and means for retaining the accessory within the body. Difficulty with such types of retaining means is that in use, it is difficult to retain the pencil within the body in a sufficiently firm manner. For example, the pencil may be pushed inwardly and/or wobble during use.

It is therefore an object of the invention to provide an accessory which may increase the effective length of a writing implement.

Another object is to provide an accessory which can firmly hold a writing implement in place during use.

An alternative object is to provide an accessory for a writing implement which may provide the public with a useful or commercial choice.

According to a broad form of the invention there is provided an accessory for increasing the effective length of a writing implement, the accessory including;

a tubular body having a passage adapted to axially receive a writing implement therethrough, the body having a threaded portion disposed towards the writing end of a writing implement therein and a retaining member which is threadably engagable with the threaded portion, and when engaged, the writing implement is selectively retained in an axial location within the passage.

The threaded portion may be located either internally or externally on the body. The retaining member is typically threaded on the other of it's internal or external surface so as to allow threadable engagement with the body.

In a preferred embodiment the body has an internal thread and the retaining member is in the form of a plug having an external thread and a bore for receiving a writing implement. Typically, the bore of the plug is complimentary to the cross section of the writing implement. For example, where the implement is a hexagonal pencil, the bore will have a hexagonal cross section. An advantage of such an arrangement is that a single body having a circular passage may be used to hold writing implements' of any desired cross section by simply providing a plug having the desired cross section. This can significantly decrease manufacturing costs.

In the embodiment where the body has an external thread, the retaining member is typically in the form of an internally threaded ring or sleeve. In this embodiment, at least that part of the passage disposed towards the writing end is typically complimentary to the cross section of the writing implement.

Typically, either one or both of the threaded portion or retaining member are tapered such that as the thread is tightened, the internal surface of the passage or the retaining member, as the case may be, contacts and retains the writing implement. To facilitate retention of the writing implement, the part i.e. the retaining member or body, that contacts the writing implement has at least one split or slot. As the two parts are threadably engaged, the splits or slots close up so as to reduce the cross section of the passage or bore and tighten against the writing implement.

In another form of the invention, either the retaining member or body has at least one tab associated with the respective threaded portion. In this embodiment, when the retaining member and threaded portion are engaged and tightened, the at least one tab is urged inwardly to contact and retain the writing implement. Typically, the at least one tab has at least one threadable ridge located on the outer face thereof for threaded engagement with the bore or retaining member as appropriate. The bore or retaining member which threadably engage the tab may be tapered such that as the two parts are threaded together, the tabs are urged inwardly. Alternatively, or in addition to, the height of the ridges may be tapered away from the writing end.

According to a further form of the invention there is provided an accessory for a writing implement including;

a tubular body having a passage adapted to axially receive a writing implement therethrough, a retaining member engagable with the body and when engaged is disposed towards the writing end of a writing implement retained therein and at least one tab located on the body or the retaining member and when the retaining member and body are engaged, the at least one tab is urged towards the writing implement so as to retain the writing implement within the passage.

According to still a further form of the invention there is provided an accessory for a writing implement including;

a tubular body having a passage adapted to axially receive a writing implement therethrough, the body having an internal threaded portion located thereon and disposed towards the end of a writing implement held thereby and a retaining member having an outer portion for threadable engagement with the body, a bore for axially receiving the writing implement and at least one tab such that when the body and retaining member are engaged the at least one tab is urged towards the writing implement so as to retain the writing implement within the passage.

In any of the embodiments of the invention, either the retaining member or the body may have a textured finger griping portion to facilitate the ease of a user to tighten or untighten the retaining member with respect to the body. Additionally or in addition to, the gripping surface may be formed form a resilient material such as a resilient plastics material.

The body may take any suitable form. Writing implements such as pens and propelling pencils may be constructed having a contoured gripping portion, whereas it is impractical to manufacture pencils thus. It is accordingly preferred to provide at least part of the outer surface of the body with a gripping surface.

The body may also be shaped in an ergonomic manner to allow a person to more easily hold the accessory than they would a conventional wooden pencil or ball point pen. For example, an accessory of an embodiment of the invention may be used by the elderly and/or those suffering from arthritis or other disability which may prevent or make it difficult for them from holding a conventional writing implement.

The body may be of any suitable length and is typically of a length which may extend the effective length of a writing implement. The body may advantageously be formed from plastic or metal and preferably from a thermoplastics material such as a polyolefin. Preferably the length of the body ranges from a minimum length for comfortably holding of the retained writing implement in use, up to about the length of a standard pencil. Typical lengths range from about 50 to about 170 mm most preferably between about 60 mm to about 100 mm.

The body may be provided with a pocket clip or the like to enable a pencil to have the pocket storage advantages of other writing implements so equipped.

DETAILED DESCRIPTION OF THE FIGURES

Figure 1:
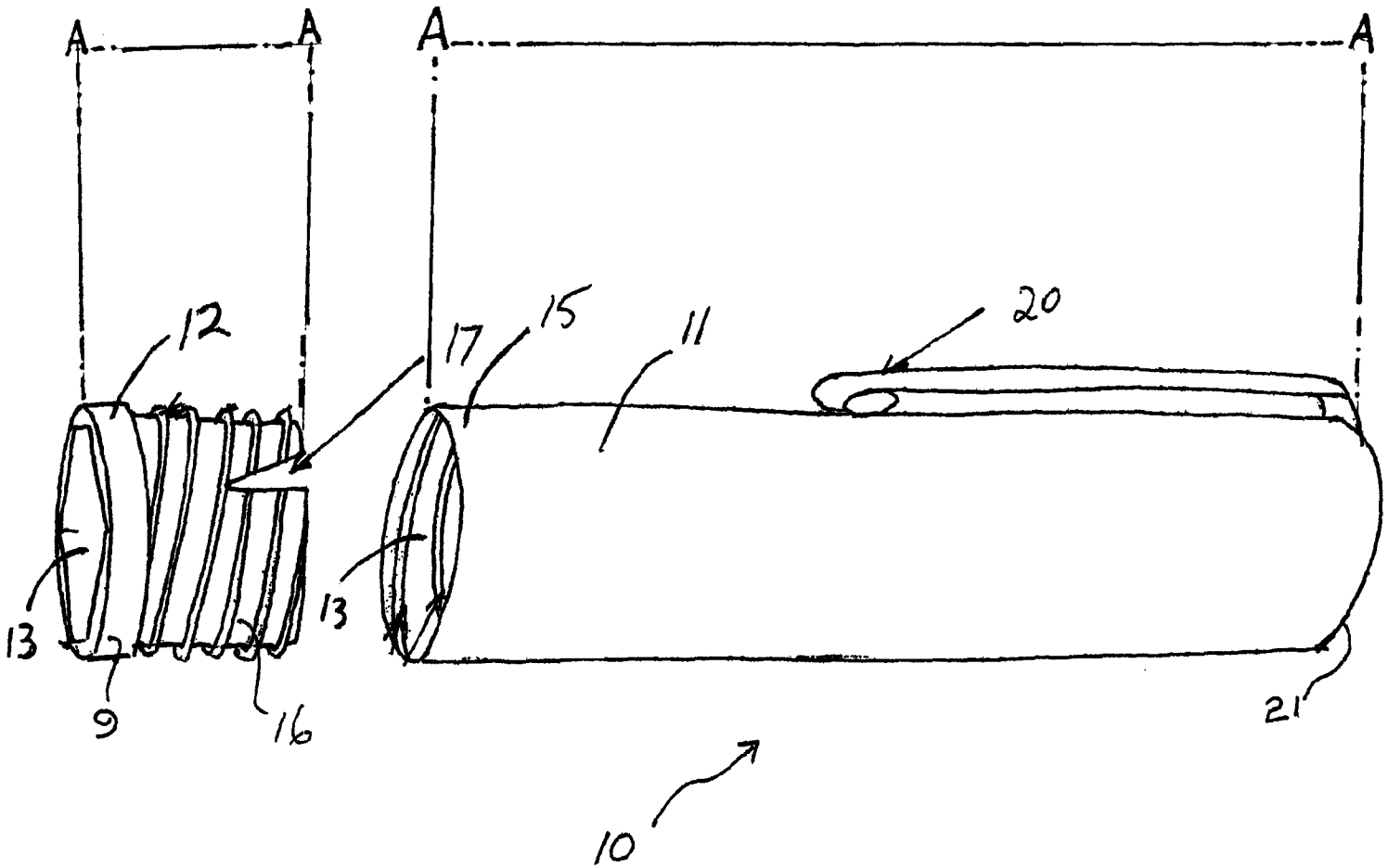
FIG. 1 is an exploded view of a preferred accessory in accordance with the present invention.
Figure 3:
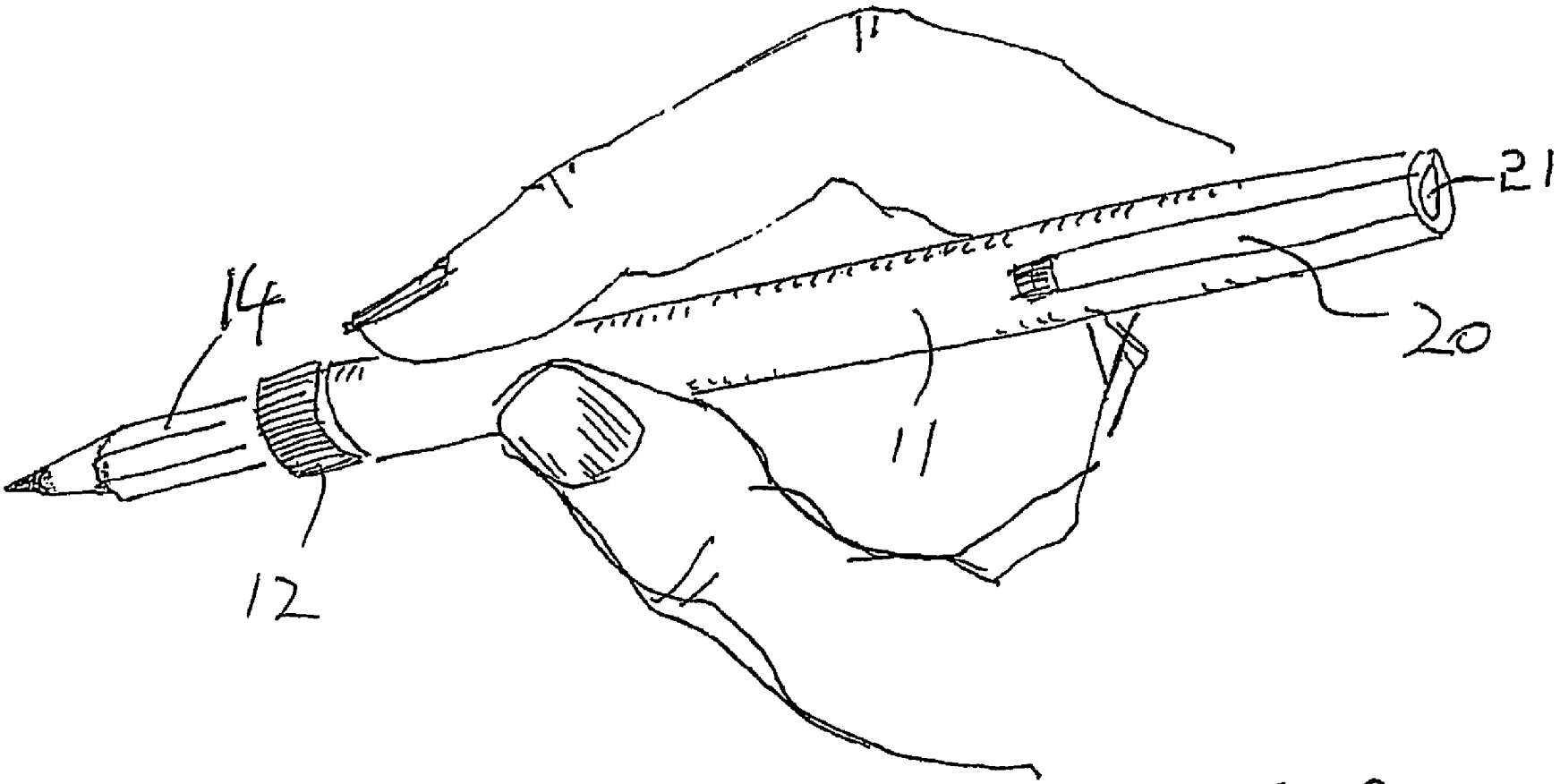
FIG. 3 is a perspective view of a preferred assembly of the present invention in use.

FIG. 1 is an exploded view of an accessory 10 of the present invention. The accessory 10 includes a body comprising a barrel 11 and a split plug 12. The body defines a passage 13 which is adapted to receive a pencil 14, as shown in FIG. 3. The barrel 11 is provided with an internally threaded end 15. The split plug 12 has an externally threaded end 16. Thread 15 is adapted to threadably engage thread 16 of the split plug 12. The split plug 12 is provided with a pair of opposed slots 17. The respective threaded portions 15, 16 are relatively tapered whereby threaded engagement of the split plug 12 with the barrel 11 causes slots 17 to close up, thereby reducing the cross section of the passage 13 of the split plug 12. In this way, a pencil 14 held within passage 13 may be retained thereby.

The barrel 11 is provided with a pocket clip 20. In this embodiment the barrel is made blind by closed end portion 21 of the barrel.

Figure 2:
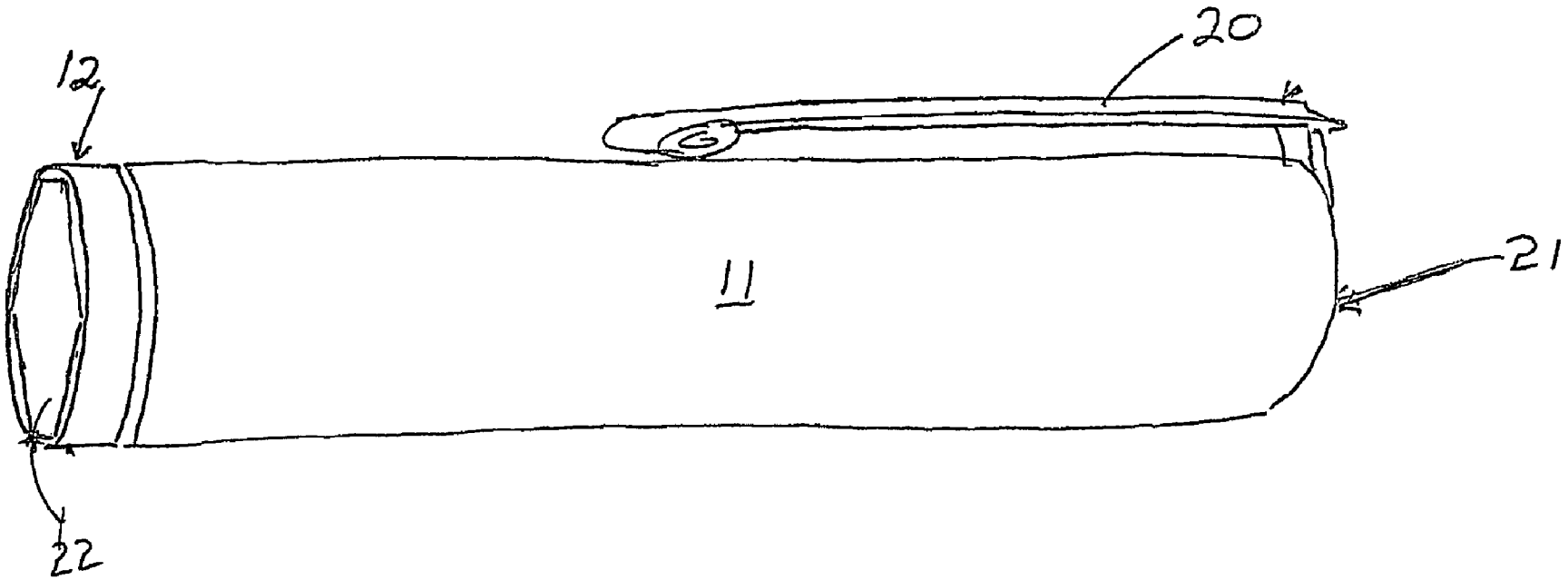
FIG. 2 is an assembled perspective view of the accessory of FIG. 1.
Figure 4:
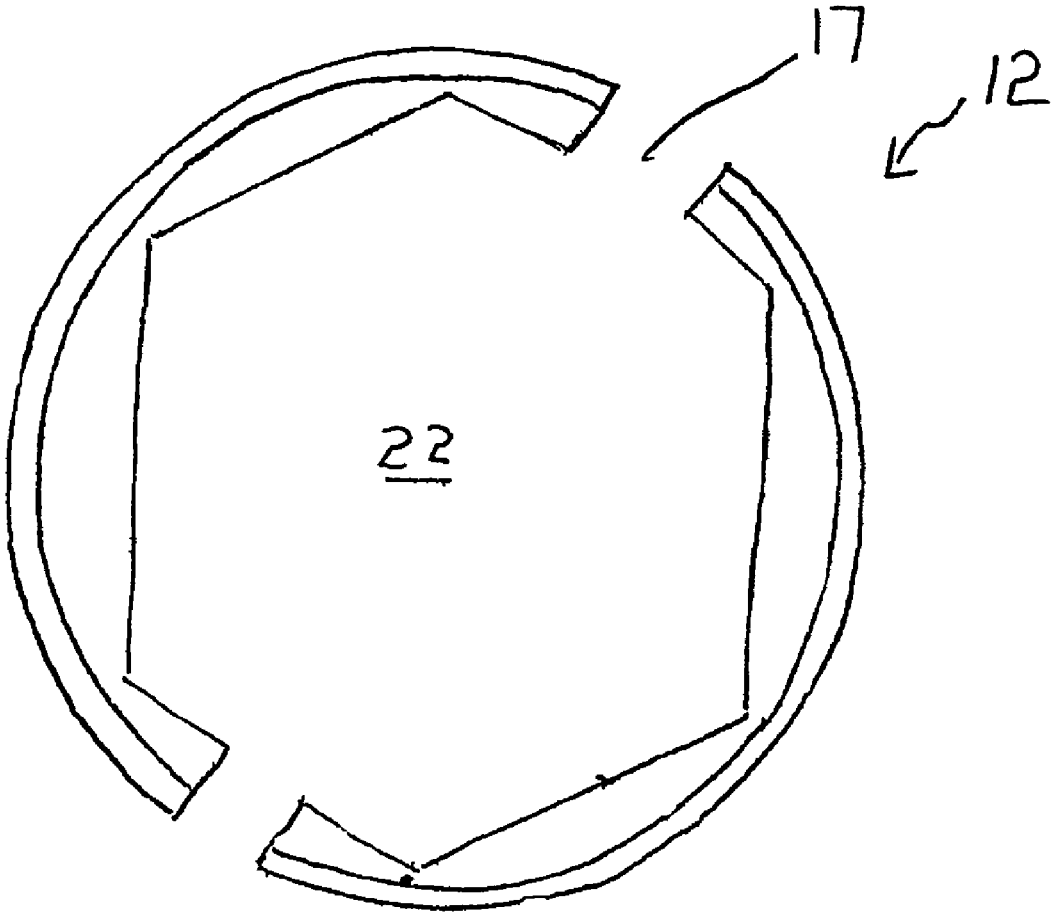
FIG. 4 is an end view of the split plug of the accessory of FIG. 2.

FIG. 2 shows the split plug 12 threadably engaged with the barrel 11. In use, the split plug 12 may be loosened or removed form the barrel 11. A pencil 14 may be inserted but end first though the opening 22 of the split plug 12. In this embodiment, the opening is hexagonal so as to accommodate a pencil of hexagonal cross section. (The hexagonal cross section may be more clearly seen in FIG. 4). The pencil 14 is inserted through the split plug 12 to the extent required for use. The split plug 12 and pencil 14 are then threadably engaged with the barrel 11 and tightened to retain the pencil 14. The writing assembly incorporating pencil 14 and accessory 10 is shown in FIG. 4. In FIG. 4, the outer surface of the split plug 12 is textured to facilitate a user's grip when tightening.

When it is desired to sharpen the pencil, the split plug 12 may be loosened by partially unscrewing the split plug 12 from the barrel 11. When loosened, the pencil 14 can be gripped about the writing end 23 and be withdrawn from the barrel.

Figure 5:
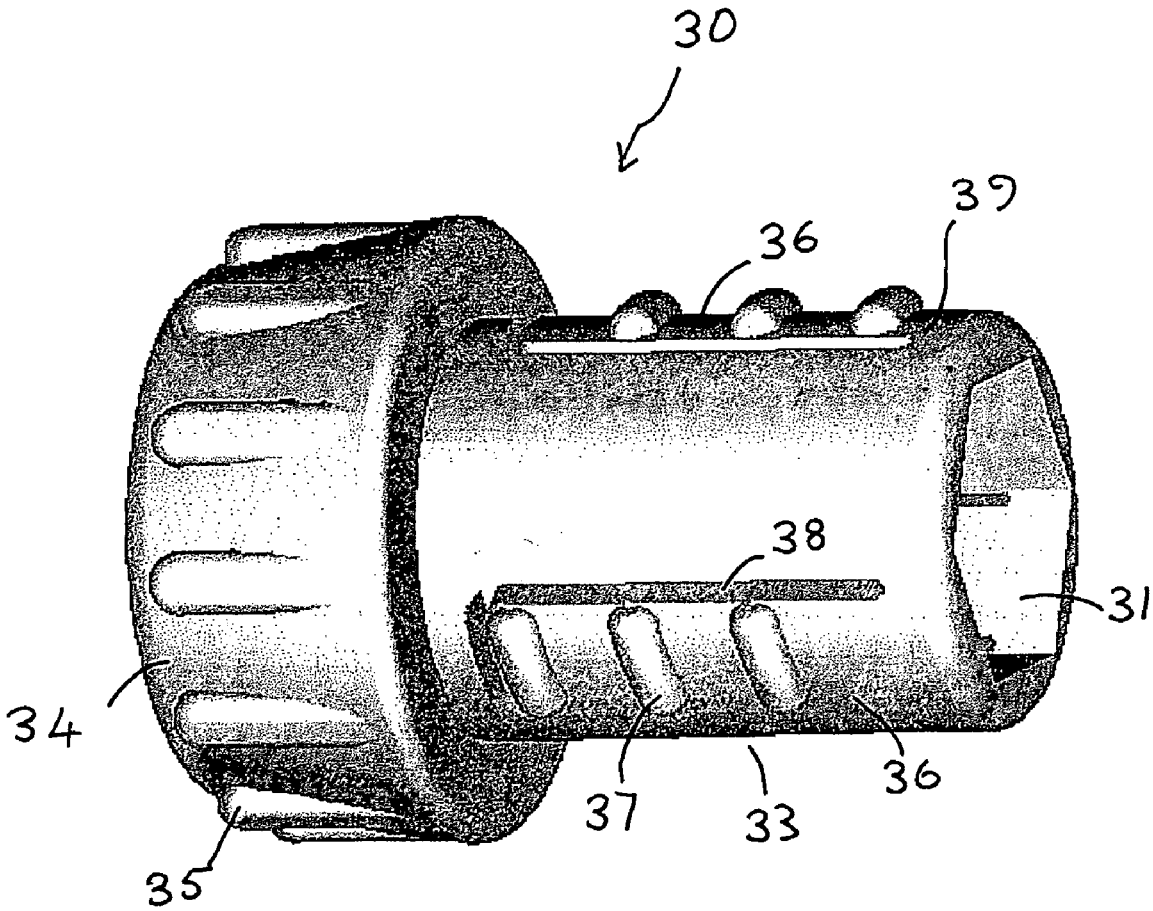
FIG. 5 is a perspective view of a further preferred plug which forms a part of a preferred accessory of the present invention and FIG. 6 is an assembled perspective view of a further preferred accessory of the present invention.

FIG. 5 is a perspective view of a further preferred plug 30 of the present invention. The plug 30 has a bore 31 complimentary to the cross section of a hexagonal pencil. The plug 30 has a shaft 33 and a base 34. The base 34 has a textured portion 35 to facilitate grip by a users fingers. The shaft 32 has four tabs 36 (two cannot be seen), each tab having a threaded section with ridges 37 defined on an outer face of the tab. In use the thread is received by the internal thread of the passage in the barrel of an accessory in a manner similar to that described with reference to FIGS. 1 to 4.

Each tab 36 is formed by providing a slit 38 around three sides thereof. The outer face of the tab on which the ridges 37 are formed is thus bound by the slit around the three sides of the tab. The slit is located entirely inward from each of the two opposing ends of the sleeve defined by the plug 30, with an area described by the slit accordingly being spaced at distances spaced inward from the two opposing ends of the sleeve along the axial length thereof. The base 39 of each tab 36 is effectively hinged to shaft 33.

The internal thread of the bore is tapered such that when the plug 30 is tightened inside the bore, the tabs 34 are depressed inwards so as to firmly clamp against the pencil.

Figure 6:
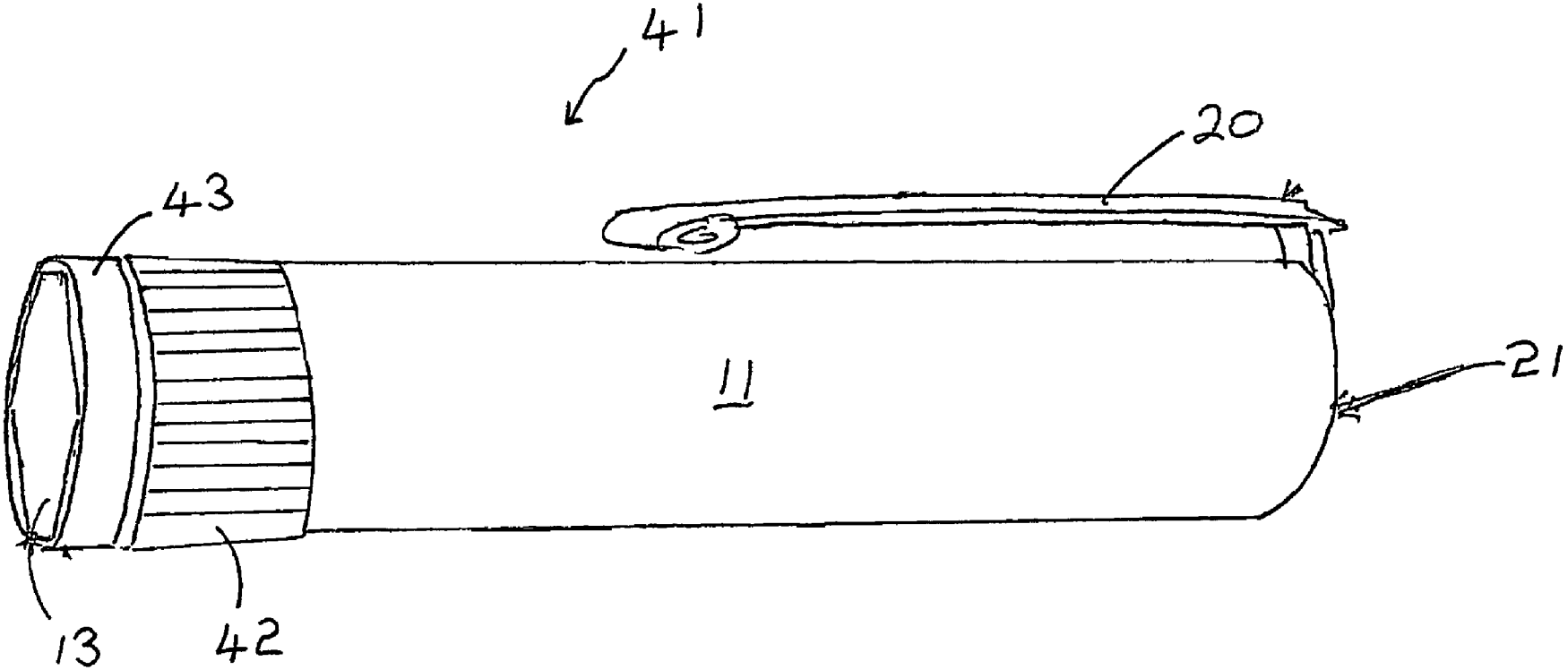

FIG. 6 shows a further preferred assembly 41 of the present invention. The same reference numerals will be used to refer to those features common to the accessory as illustrated in FIG. 2. The accessory has a barrel 11 with a passage 13. The passage 13 is hexagonal which is complimentary to a pencil having a hexagonal cross section. The accessory 41 has a retaining ring 42 with an external thread which is threaded onto body 11. The barrel 11 has an end collar 43 to prevent the ring 42 from being inadvertently unscrewed from body 11.

The portion of the barrel 11 located beneath the ring 42 has a tab arrangement (hidden beneath ring 42) similar that that illustrated for the shaft of the plug 30 as shown in FIG. 5.

Figure 7:
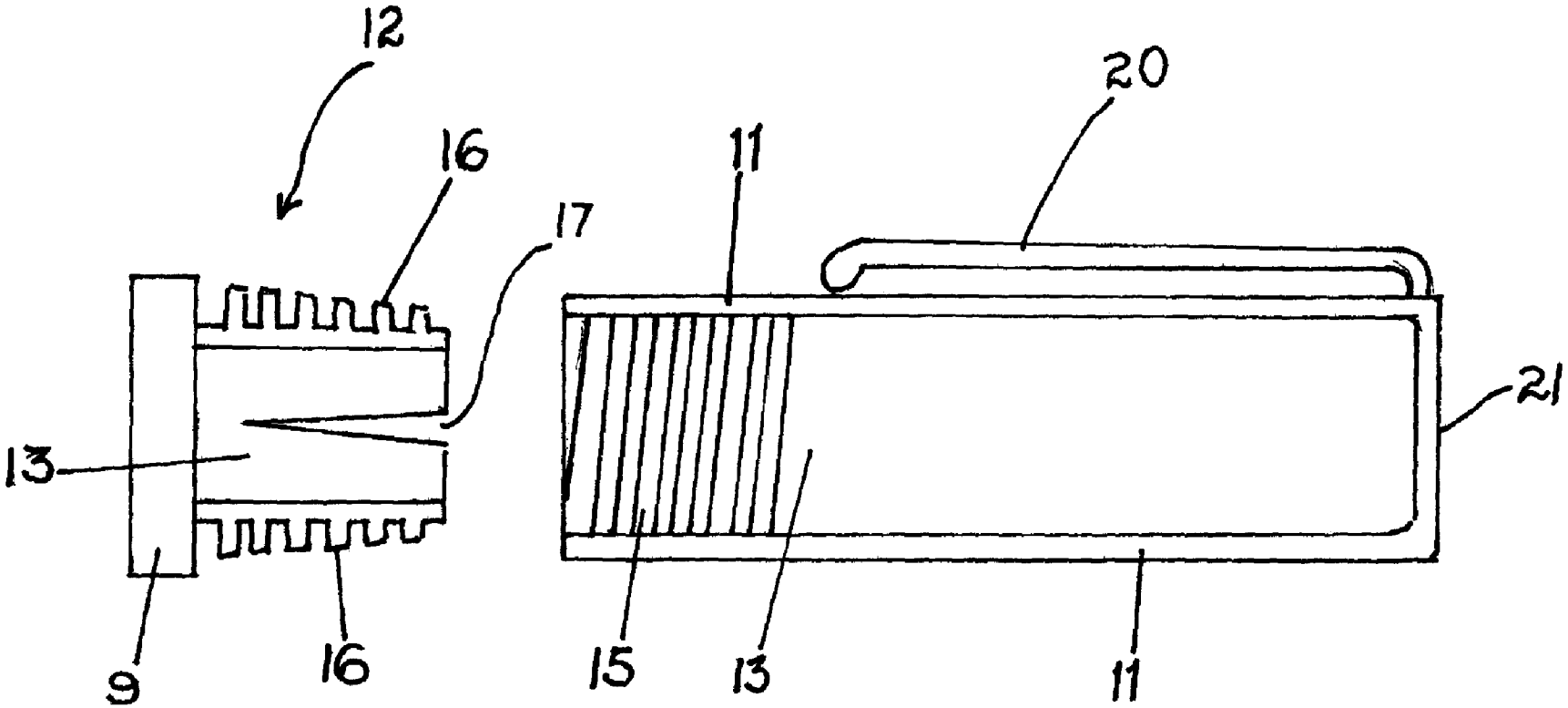
FIG. 7 is a side sectional view taken along line A-A.

FIG. 7 shows a side sectional view taken along line A-A indicated in FIG. 1, where the externally threaded portion 16 of the retaining means 12 is tapered relative to the Internally threaded portion 15 of the tubular body 11.

Figure 8:
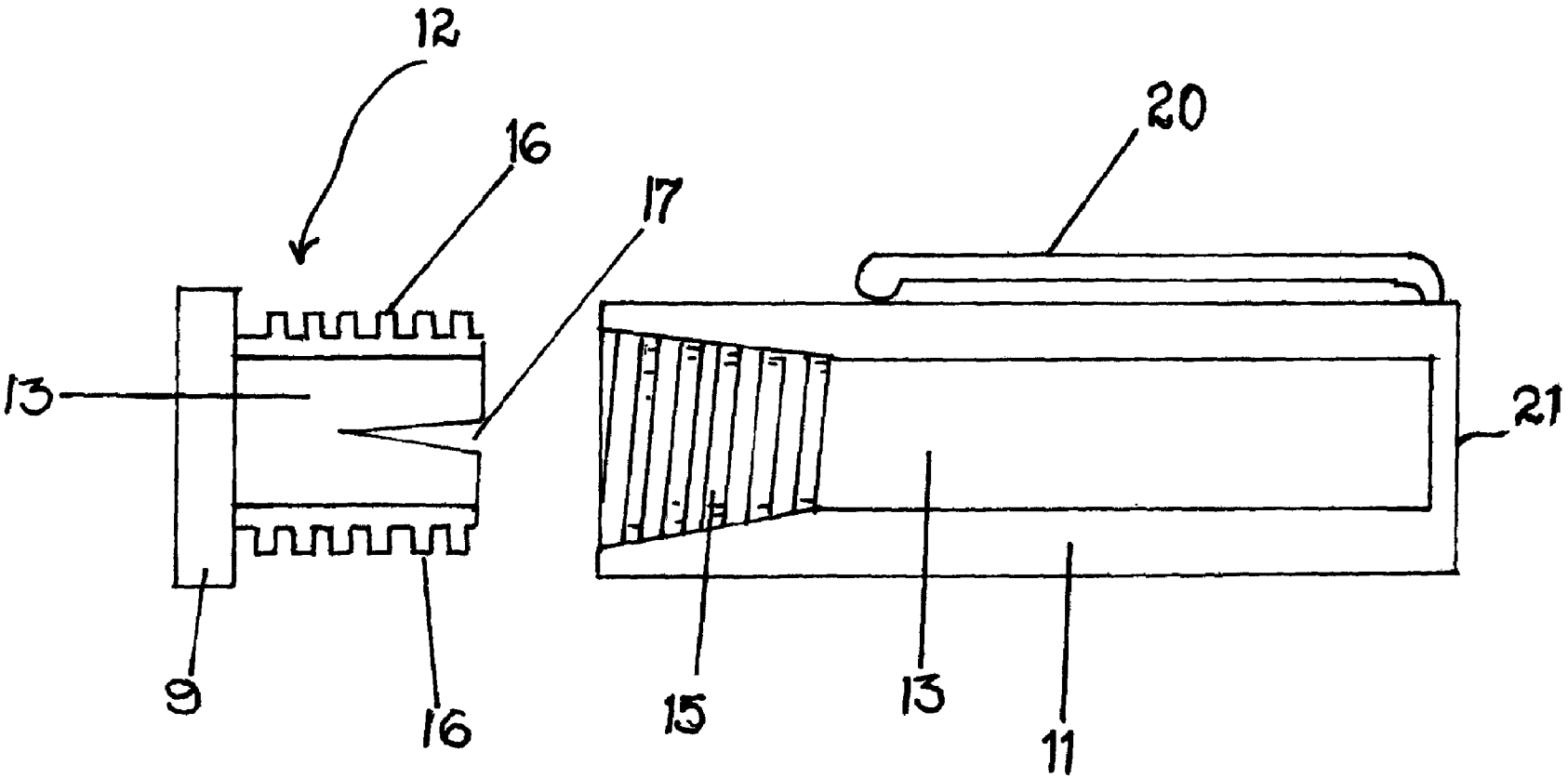
FIG. 8 is a side sectional view taken along line A-A.

FIG. 8 shows a side sectional view taken along the line A-A indicated in FIG. 1, where the internally threaded portion 15 of the tubular body 11 is tapered relative to the externally threaded portion 16 of the retaining means 12

Figure 9:
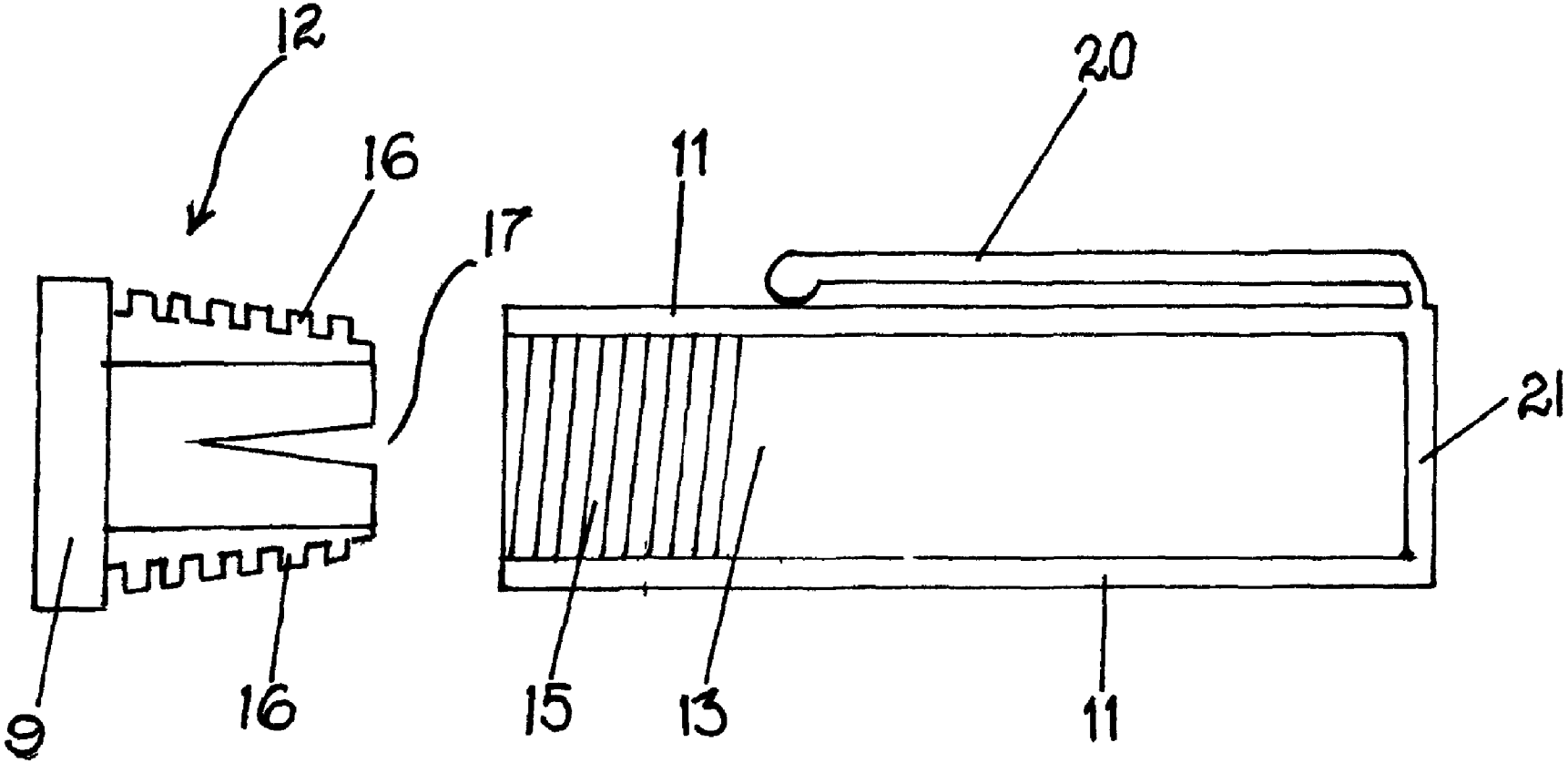
FIG. 9 is a side sectional view taken along line A-A.

FIG. 9 shows a side sectional view taken along the line A-A indicated in FIG. 1, where the externally threaded portion 16 of the retaining means 12 is tapered relative to the internally threaded portion 15 of the tubular body 11.

Figure 10:
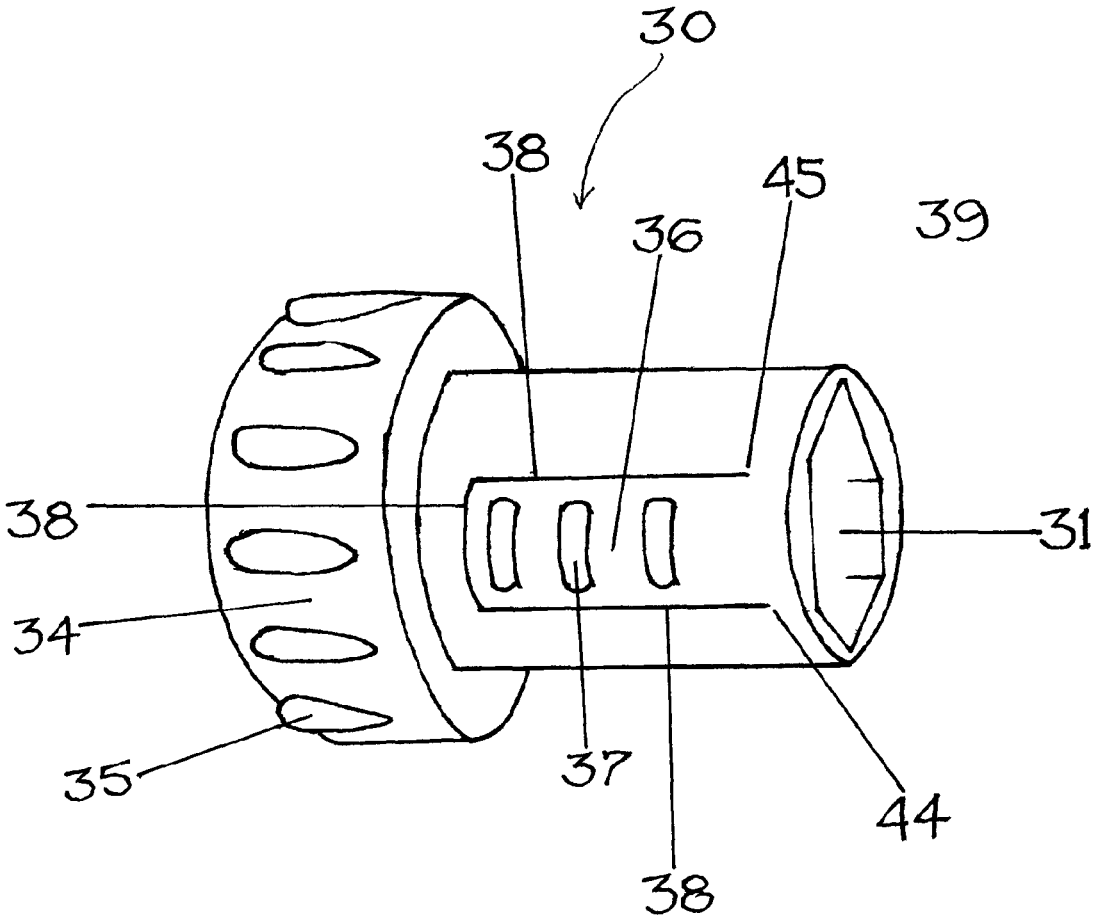
FIG. 10 is a perspective view of retaining means.

FIG. 10 is a perspective view of the retaining means shown in FIG. 5 and the ends 44 and 45 of split 38 which forms the edge of tab 36 are indicated. It can be seen that split 38 is longer than the distance between 44 and 45.

Figure 11:
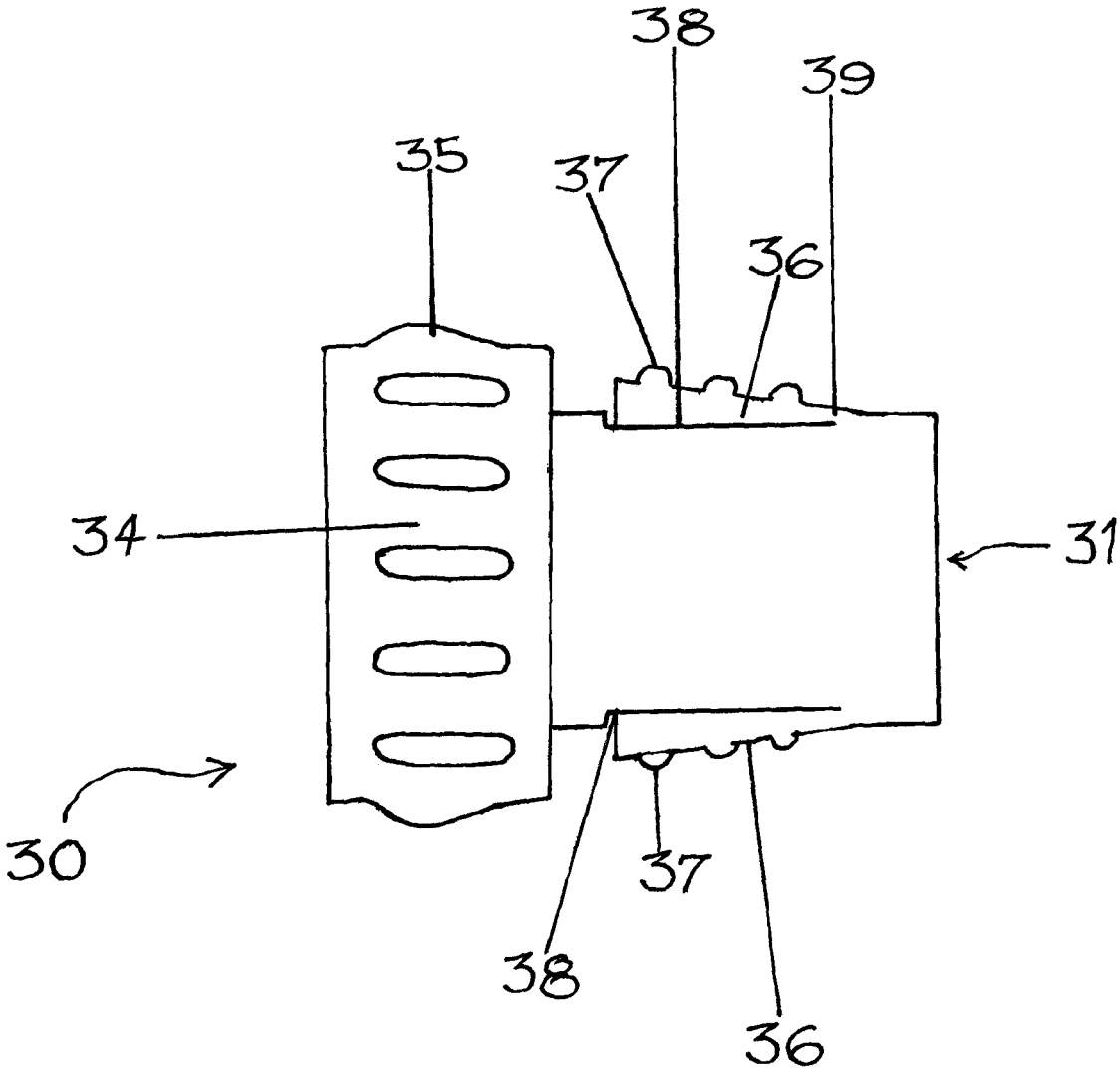
FIG. 11 is a side view of retaining means.

FIG. 11 is a side view of retaining means shown in FIG. 5 and FIG. 10 and shows externally threaded portion 16 tapered.

The accessory of any embodiment of the invention may also be covered with a separate pencil point cover (not shown) which can protect the pencil point when not in use. Typically the cover is engagable with the barrel 11. Alternatively, the pencil may be removed form the barrel and inserted point end first into the barrel and the two parts tightened so as to retain the pencil with the pointed end located within the passage. In this way the point is protected. Such protection may be particularly advantageous should it be desired to carry a pencil in a pocket, bag, knapsack or the like. In such cases, an exposed pencil point may be subject to damage and/or mark or damage other objects in a pocket, bag or the like.

It may be seen that the accessory of the present invention may be used to retain a writing implement such as a pencil in a firm and efficient manner. The accessory may be used with pencils of virtually any length and allows the use of shortened pencils or pencil stubs which under normal circumstances would be discarded. This can significantly extend the life of a pencil. Further, the accessory may provide a more comfortable feel and/or grip than a conventional wooden pencil or ball point pen. Still further, the accessory may allow for the tip of a pencil or the like to be covered. The accessory may be re-used a number of times.

It will be appreciated, that while the above has been given by way of illustrative example of the invention, all such modifications and variations thereto that would be apparent to persons skilled in the art are deemed to all within the broad scope and ambit of this invention as is herein set forth.

The invention claimed is:

1. An accessory for a writing implement, including:

a tubular body having at least one open end having an internal thread for engagement with an externally threaded portion of a retaining means;

the retaining means comprising a sleeve having an internal passage to accept axial insertion of the implement and having at least one tab described by a split in the sleeve around three sides of said tab, said split being longer than a distance directly between ends of said split and said at least one tab having an externally threaded portion defined on an outer face of the tab that is bound by said three sides of the tab, said externally threaded portion having a taper relative to said internal thread of the tubular body;

wherein said split permits the said at least one tab to flexion across an area between the ends of the split to move the externally threaded portion inwardly; and wherein threadably engaging the retaining means with the tubular body flexions the at least one tab, moving the tab and the externally threaded portion thereon inwardly to press the at least one tab against the implement and retain the implement in the retaining means.

2. The accessory of claim 1, in which the at least one split is located entirely inward from each of two opposing ends of the sleeve along an axial length thereof.

3. An accessory for a writing implement, including:

a tubular body comprising at least one open end having an internal thread for engagement with an externally threaded portion of a retaining means;

the retaining means comprising a sleeve having an internal passage to accept axial insertion of the implement and having at least one tab described by a split in the sleeve around three side of said tab, wherein said split is longer than a distance directly between ends of said split;

wherein said at least one tab has an externally threaded portion defined on an outer face of the tab that is bound by said three sides of the tab, said externally threaded portion having a taper relative to said internal thread of the tubular body; and wherein threadably engaging the retaining means with the tubular body flexions the at least one tab, moving the tab and the externally threaded portion thereon inwardly to press the at least one tab against the implement and retain the implement in the retaining means.

4. The accessory of claim 3, in which the at least one split is located entirely inward from each of two opposing ends of the sleeve along an axial length thereof.

5. An accessory for a handheld writing implement, including:

a retaining means comprising a sleeve, said sleeve having an internal passage accepting axial insertion of the implement and having at least one externally threaded portion, said sleeve also having at least one split located entirely inward from each of two opposing ends of the sleeve along an axial length thereof, where said split describes a shaped area within the structure of the retaining means at distances spaced inward from the two opposing ends of the sleeve along the axial length thereof; and a tubular body comprising at least one open end having an internally threaded portion for engagement with the externally threaded portion of the retaining means;

wherein threadably engaging the retaining means with the tubular body tightens the retaining means retaining the implement therein.

* * * * *